US005507462A

United States Patent [19]

Hickey

[11] Patent Number: 5,507,462

[45] Date of Patent: Apr. 16, 1996

[54] TWISTED METAL HANGER

[76] Inventor: Joseph F. Hickey, 217 Mountain Ave., Gillette, N.J. 07933

[21] Appl. No.: 383,849

[22] Filed: Feb. 6, 1995

Related U.S. Application Data

[62] Division of Ser. No. 107,638, Aug. 18, 1993.

[51] Int. Cl.[6] ..... A47G 1/16

[52] U.S. Cl. ..... 248/489; 248/493; 248/301

[58] Field of Search ..... 248/300, 301, 248/475.1, 489, 493, 496, 497

[56] References Cited

U.S. PATENT DOCUMENTS

| | | | |
|---|---|---|---|
| 1,049,128 | 12/1912 | Moore | 248/301 |
| 1,255,274 | 2/1918 | Babitzky | 248/301 X |
| 1,521,466 | 12/1924 | Mills | 248/301 X |
| 2,137,837 | 11/1938 | Freudenberger | 248/493 |
| 2,317,368 | 4/1943 | Frey | 2488/475.1 X |
| 2,334,700 | 11/1943 | Frey | 248/493 |
| 2,940,712 | 6/1960 | Lloyd-Young | 248/301 X |
| 3,057,590 | 10/1962 | Allen | 248/493 |
| 3,294,356 | 12/1966 | Sherman | 248/310 X |
| 4,026,510 | 5/1977 | Holmes | 248/493 |
| 5,178,355 | 1/1993 | Herzig | 248/489 |

*Primary Examiner*—Alvin C. Chin-Shue
*Assistant Examiner*—Derek J. Berger
*Attorney, Agent, or Firm*—Marion P. Lelong

[57] ABSTRACT

A hanger for supporting objects such as pictures and mirrors is made of a bendable metal strip or from a molded plastic, having on one end a groove which is parallel to a wall and uppermost when mounted on the wall for supporting a picture. This groove is particularly suitable for fitting into and supporting a saw tooth clip installed on the top frame of a picture, mirror, or the like, but it is also suitable for supporting a picture hanger wire, without being exposed to view above the frame when supporting either the clip or the wire.

9 Claims, 1 Drawing Sheet

TWISTED METAL HANGER

This application is a division of application Ser. No. 08/107,638, filed Aug. 18, 1993, and now pending.

BACKGROUND OF THE INVENTION

1. Field of the Invention

This invention relates to hangers that are attached to walls for supporting objects such as mirrors and pictures mounted in frames. It particularly relates to hangers that are attached to walls by driving a nail through the hanger and into the wall.

2. Review of the Prior Art

U.S. Pat. No. D55,157 of Dubish shows a curtain and shade hanger having integral spikes, which are driven into a wall, and an outwardly projecting horizontal portion having a depression in its upper edge.

U.S. Pat. No. 1,675,281 of Strand relates to a hanger that is made from a strip of bendable sheet metal. The strip is bent upwardly near one end to provide a back portion and an upturned hook and then bent 90° in the same direction near the other end to provide a horizontal part which is again bent 90° downwardly to provide a very short vertical part which is again bent slightly less than 45° to provide an inclined part. The very short vertical part and the back portion are provided with holes so that a nail can be placed through the holes, at about a 45° angle to the back portion, for attaching the hanger to a wall.

U.S. Pat. No. 2,940,712 of Lloyd-Young shows a picture hanger affixed to a wall panel by two nails driven so as to intersect beyond the panel. The nails are inserted into inclined loops formed in a sheet metal strip which is disposed perpendicularly to the panel, twisted 90° below the lower nail, and then bent outwardly and upwardly to form a hook.

U.S. Pat. No. 3,226,065 of Smith shows a picture hook for positively positioning picture wire for maintaining pictures in proper level position over extended periods of time. A strip of sheet metal is formed at one end into an inclined loop through which a nail is driven into a wall. Below the nail, the strip is twisted 90° to present a flat lower portion which is parallel to the wall and bent at the corners of its bottom edge to create a pair of upturned tabs behind which a picture wire is hung.

U.S. Pat. No. 3,861,631 of Shorin describes an integral polymeric hanger for hanging pictures on a plaster board wall. The hanger comprises an elongated strip having a hole at one end for driving a nail transversely into the wall. A locking flap is attached below the hole and extends downwardly and outwardly to terminate in a depending lip. The strip extends below the flap and is then curved outwardly and upwardly to terminate in an upwardly facing lip in proximate spaced relation to the downwardly depending lip. Both lips decrease in thickness toward their edges.

U.S. Pat. No. 3,982,719 of Kolbourne shows a hanger, shaped like an upside-down Y, for supporting pictures, mirrors, decorative plaques, and framed diplomas, certificates, and mementos. The hanger comprises a metal strip which is divided at one end into diverging arms and bent outwardly near the other end to create a horizontal ledge and then bent downwardly and provided with aligned apertures at its downward bend and in its vertical portion below the outward bend through which a nail is driven into a wall. The diverging arms are bent outwardly and then upwardly to create a pair of upturned hooks behind which a picture wire is placed.

U.S. Pat. No. D251,180 of Mader et al shows a display hook which comprises a metal strip having an upturned hook at one end and an elongated, forwardly extending ledge at the other end which terminates in an upwardly bent hook. Holes are provided near both hooks, and two tabs extend perpendicularly from the strip.

All of these hangers are directed to pictures and other framed objects having metal wires strung across their backs for hanging onto a wall. Many pictures, mirrors, and the like, however, do not use such wires but instead have a saw-tooth hanging device attached to their backs at the center of the top frame member, such as the picture hanger or clip shown in U.S. Pat. No. D241,711 of Wallace. Mounting a picture having a saw-tooth hanger at its back onto the hook of a hanger such as those described in the Strand and Lloyd-Young patents, for example, always causes the upper part of the hanger to be exposed. There is accordingly a need for a hanger that is strong, reliable, and suitable for use with a saw-tooth clip without being exposed to view above the picture.

SUMMARY OF THE INVENTION

It is accordingly an object of this invention to provide a hanger that is not exposed to view when a mirror or a picture having a saw-tooth clip or a picture wire is mounted thereon.

It is another object to provide a hanger that is strong and reliable.

It is a further object to provide a hanger that is stable.

In accordance with these objects and the principles of this invention, a hanger is provided that comprises a first end, a second end, a diagonally disposed first nail hole therethrough which is near the first end, a second nail hole therethrough which is near the second end, and a groove in the first end which is disposed to face away from the second end and is adapted to receive and support a picture wire or a saw-tooth clip fastened to a picture frame when the hanger is attached to a wall. The upper and lower nailing positions prevent swivelling of the hanger. The hanger may be made of metal or a strong, tough plastic, such as propylene, nylon, or polycarbonate. The groove in a metal hanger is sharp enough to at least minimize sidewise movement of a picture wire, and the groove in a plastic hanger is elongated and has an apex that also tends to maintain the picture wire where it is placed.

When made of metal, the hanger is made from a bendable metal strip by:

A) forming a V-shaped groove in one edge thereof, bending the strip through 90° near the groove to separate a groove portion from a straight wall portion, bending the groove portion of the strip on the other side of the groove in the same bending direction through approximately 120° to form a support portion beyond the second bend, and finally bending the end of the support portion in the opposite direction to form a terminal portion which is parallel to and in contact with the wall portion;

B) twisting the groove portion through about 90°, whereby the groove is disposed away from the terminal portion;

C) drilling a hole in the support portion close to the second bend and drilling another hole in the wall portion, whereby the holes are diagonally aligned with respect to the wall portion; and D) drilling perpendicularly aligned holes through the terminal portion and through the wall portion.

When made from a bendable metal strip having side edges, the hanger comprises:

A) a straight wall portion having a longitudinal axis;

B) a straight groove portion which:

1) is attached to and disposed perpendicularly to the straight wall portion, 2) is twisted through about 90° to be substantially parallel to the axis, and 3) has a notch-like groove in one side edge;

C) a support portion which:

1) is attached to the groove portion, 2) is disposed at approximately 60° to the groove portion, and 3) is disposed at approximately 30° to the wall portion; and D) a terminal portion which is attached to the support portion and is parallel to and substantially in contact with the wall portion.

This metal hanger has its first nail hole in the form of two holes through the support portion and through the wall portion, these holes being aligned substantially [in parallel to the axis of the wall portion] within a plane that passes through said longitudinal axis and is perpendicular to a plane disposed in parallel to said straight wall portion, said holes being additionally disposed diagonally to the straight wall portion. The hanger also has its second nail hole in the form of two holes through the terminal portion and through the wall portion, these holes being perpendicularly aligned to the terminal portion and the wall portion.

The second nail is driven into the wall primarily as a shear connection; however, it also prevents the hanger from rotating and adds to its overall strength. Using both nails, the hanger supports a weight of 40 to 50 pounds, as compared to a commercial hanger, made of the same stock, that is rated at 30 pounds.

When made of plastic, the hanger is cast in solid form, thereby filling in the space defined by the wall portion, the groove portion, and the support portion of the metal hanger. The hanger comprises a first end, a second end, a diagonally disposed first nail hole therethrough which is near the first end, and a second nail hole therethrough which is near the second end, the first end having a groove which is disposed to face away from the second end, this groove being adapted to receive and support a picture wire or a saw-tooth clip which is fastened to a picture frame when the hanger is attached to a wall, without being exposed to view above the frame. The groove is elongated, elevated at its center, and preferably has sloping sides.

When made of plastic, the hanger comprises a body portion having a groove end, a support end, a wall surface, a front surface, side edges, and a nail hole, the groove end having a groove which is parallel to the wall surface. The groove has side edges and a center which is farther than the side edges from the support end.

Using both nails, the hanger supports a weight of 40 to 50 pounds. For both the metal hanger and the plastic hanger, however, a single nail through the first nail hole is sufficient for supporting light objects, such as small picture frames weighing up to 10 pounds.

The groove is preferably V-shaped and has a V-shaped bottom, the highest point of the bottom being in the middle thereof when the hanger is attached to the wall.

The plastic used for making the plastic hanger is a strong, tough plastic, such as one selected from the group consisting of polypropylene, epoxy, nylon, and polycarbonate.

DESCRIPTION OF THE PREFERRED EMBODIMENTS

Figure 1:
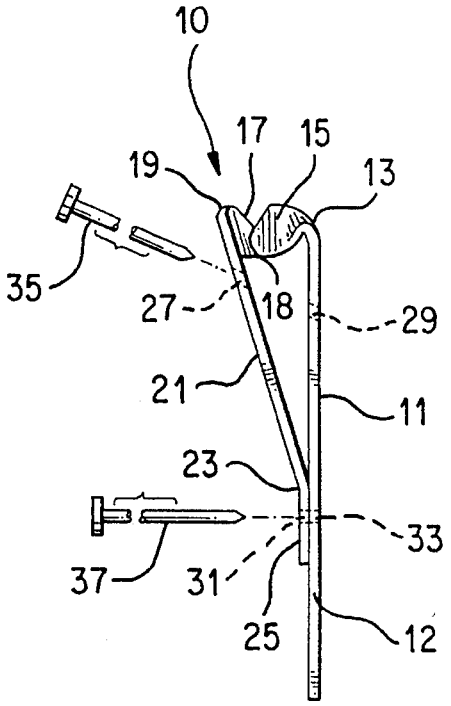
FIG. 1 is a side elevation of the metal hanger of the invention, showing two nails about to be inserted into the two pairs of holes for attaching the hanger to a wall.
Figure 2:
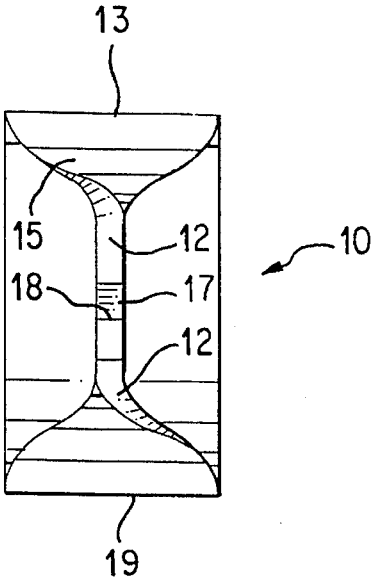
FIG. 2 is a top view of the hanger shown in FIG. 1.
Figure 3:
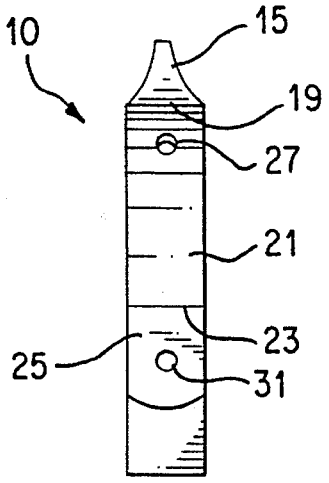
FIG. 3 is a front view of the hanger shown in FIGS. 1 and 2.

As shown in FIGS. 1–3, hanger 10 is made from a bendable metal strip in which a groove 17 is made in one edge 12 thereof. The strip is bent 90° at first bend 13 on one side of groove 17 to separate wall portion 11, having edge 12, from groove portion 15 containing groove 17. Second bend 19 is then made on the other side of groove 17 through approximately 120° and in the same bending direction as first bend 13 to separate groove portion 15 from the remainder of the strip which is bent a third time at third bend 23 to separate support portion 21 from terminal portion 25 which is in parallel to and substantially in contact with wall portion 11. Groove portion 15 is then twisted about 90°, whereby groove 17 faces away from support portion 21 and terminal portion 25. Groove portion 15 is disposed perpendicularly to straight wall portion 11, but groove 17 is disposed in parallel to wall portion 11.

Holes 27, 29 are next drilled so they are aligned diagonally with respect to wall portion 11, hole 29 being farther from bend 13 than hole 27 is from bend 19. Finally, aligned holes 31, 33 are drilled approximately perpendicularly through terminal portion 25 and wall portion 11, respectively.

When hanger 10 is attached by nails 35, 37 to a wall, hanger 10 is strong and rigid, tightly attached to the wall, and unable to swivel although a load from a picture is slightly above hole 29. The sharpness of V-shaped groove 17, having bottom 18, enables a picture wire to be caught and held exactly where placed when a picture or mirror or like object is hung upon metal hanger 10.

Figure 4:
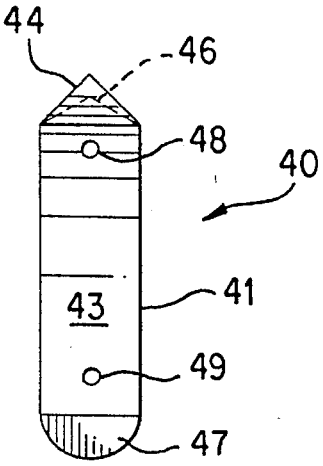
FIG. 4 is a front view of a preferred embodiment of the plastic hanger.
Figure 5:
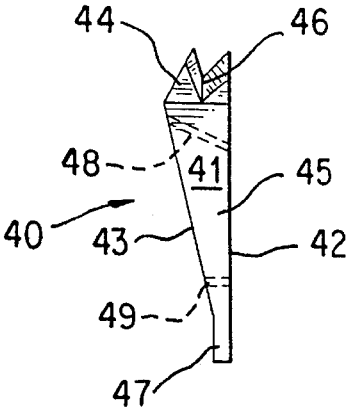
FIG. 5 is a side view of the plastic hanger shown in FIG. 4.

As shown in FIGS. 4 and 5, plastic hanger 40 comprises groove portion 44, body portion 45 having a groove end and a support end, terminal portion 47, elongated notch or groove 46, sloping front surface 43, wall surface 42, sides 41, and holes 48, 49. Groove portion 44 can also be eliminated by forming groove 46 in the groove end of body portion 45 at any desired distance from back surface 42. Front surface 43 can slope toward back surface 42 and terminate at any desired thickness of body portion 45, as shown in FIG. 5, or it can be parallel to wall surface 42, thereby eliminating terminal portion 47.

When plastic hanger 40 is attached to a wall, the center of groove 46 is sufficiently elevated above its sides that it easily fits into a groove between saw teeth of a picture hanging clip that is attached to the top frame member of a picture or the like, thereby being hidden from view. It is also well adapted to accept a picture wire attached to a picture frame and, because of the sharpness of its apex, to minimize any tendency for the wire to slip sideways while also being hidden from view.

Elongated hole 48 is diagonally disposed within body portion 45, whereby a first nail can be driven downwardly into a wall when hanger 40 is being thereby attached to the wall. Hole 49 is preferably perpendicularly disposed to the wall in order to drive a second nail into the wall for stabilizing hanger 40 and reinforcing the first nail. Groove end portion 44 is uppermost when hanger 40 is attached to a wall for supporting a picture, mirror, or the like, and terminal portion 47 is lowermost. Groove 46 accordingly is able to receive and retain a saw-tooth clip or a picture wire without difficulty so that the frame of the picture completely hides hanger 40 from view.

Hanger 40, being manufactured from a strong, tough plastic such as propylene, epoxy, nylon, or polycarbonate, is inexpensive to manufacture, light in weight, strong and rigid, easy to handle and attach to a wall, and dependable for supporting heavy loads. Plastic hanger 40 can also have other shapes.

Hangers 10, 40 can be produced in a range of sizes for supporting picture and mirror frames of a variety of sizes and weights. In general, having the groove close to the wall is advantageous when supporting a very small picture because the picture is able to hug the wall. It is also advantageous when supporting a very heavy picture or other flat objects because pivoting forces on the uppermost nail are minimized.

A commercial metal hanger rated at 30 pounds was straightened and then bent according to the invention. With nails 35, 37 driven through holes 27, 29 and 31, 33, respectively, into a sheetrock wall, hanger 10 was tested in increments of 5 pounds with a wire in its groove 17 that supported the test weights. Above 40 pounds, the nails began to sag and eventually sagged about ⅛-inch at 50 pounds because of compression of the sheetrock. As more weight was added above 40 pounds, groove portion 15 also dropped while support portion 21 bent and terminal portion 25 slid downwardly over wall portion 11. Weights over 50 pounds began to cause hanger 10 to pull away from the wall.

The same test applied to a commercial picture hanger rated for 30 pounds caused the hanger to begin to collapse after 40 pounds were added and to completely bend when 50 pounds were applied.

Plastic hanger 40 was similarly tested. It supported 42 pounds and parted from the wall at 45 pounds.

It was apparent that both metal hanger 10 and plastic hanger 40 could readily support light objects, such as picture frames weighing up to 10 pounds, when attached to a sheetrock wall with a single nail through first holes 27, 29 or diagonal hole 48.

Because it will be readily apparent to those skilled in the hanger art that innumerable variations, modifications, applications, and extensions of the principles hereinbefore set forth can be made without departing from the spirit and the scope of the invention, what is hereby defined as such scope and is desired to be protected should be measured, and the invention should be limited, only by the following claims.

What is claimed is:

1. A twisted metal hanger, made from a bendable metal strip having side edges, having a first end, a second end, a diagonally disposed first nail hole therethrough which is near said first end, and a second nail hole therethrough which is near said second end, said first end having a groove which is disposed to face away from said second end, said groove being adapted to receive and support a picture wire or a saw-tooth clip, which is fastened to a picture frame when said hanger is attached to a wall, without being exposed to view above said picture frame, comprising:

A) a straight wall portion having a longitudinal axis;

B) a straight groove portion which:
1) is attached to and disposed perpendicularly to said straight wall portion,
2) is twisted through about 90° to be substantially parallel to said axis, and
3) has said groove in one said side edge, said groove being parallel to said straight wall portion;

C) a support portion which:
1) is attached to said groove portion,
2) is disposed at less than 90° to said groove portion, and
3) is diagonally disposed to said wall portion; and D) a terminal portion which is attached to said support portion and is parallel to and substantially in contact with said wall portion.

2. The metal hanger of claim 1, wherein said first nail hole is in the form of two holes through said support portion and through said wall portion, said holes being substantially within a plane that passes through said longitudinal axis and is perpendicular to a plane disposed in parallel to said straight wall portion, said holes being additionally disposed diagonally to said straight wall portion.

3. The metal hanger of claim 1, wherein said second nail hole is in the form of two holes through said terminal portion and through said wall portion, said holes being perpendicularly aligned to said terminal portion and said wall portion.

4. A twisted metal hanger made from a bendable metal strip having side edges, said hanger having a first end and a second end and comprising:

A) a straight wall portion having a longitudinal axis;

B) a groove portion which:
1) is attached to and bent perpendicularly to said straight wall portion to form said first end,
2) is twisted through about 90° to be substantially parallel to said axis, and
3) has a notch-like groove in one said side edge, said groove being disposed to face away from said second end;

C) a support portion which:
1) is attached to said groove portion and bent to form an angle of approximately 60° to said groove portion, and
3) is disposed at approximately 30° to the wall portion; and D) a terminal portion which is attached to said support portion and is parallel to and substantially in contact with said wall portion, said terminal portion forming said second end, said groove being adapted to receive and support a picture wire or a saw-tooth clip, fastened to a picture frame when said hanger is attached to a wall, without being exposed to view above said picture frame.

5. The metal hanger of claim 4 which further comprises a first nail hole which is near said first end and in the form of two holes through said support portion and through said wall portion, said holes being substantially within a plane that passes through said longitudinal axis and is perpendicular to a plane disposed in parallel to said straight wall portion, said holes being additionally disposed diagonally to said straight wall portion.

6. The metal hanger of claim 5 which further comprises a second nail hole which is near said second end and is in the form of two holes through said terminal portion and through said wall portion, said holes being perpendicularly aligned to said terminal portion and said wall portion.

7. A metal hanger made from a bendable metal strip having side edges, a first end, and a second end, said hanger comprising:

A) a straight wall portion having a longitudinal axis and said first end of said metal strip;

B) a groove portion which:

1) is bent, as a first bend, through about 90° to be substantially perpendicular to said wall portion, 2) is twisted through about 90° to be substantially parallel to said axis, and 3) has a notch-like groove in one said side edge, said groove being disposed to face away from said first end of said metal strip and being adapted to receive and support a picture wire or a saw-tooth clip, fastened to a picture frame when said hanger is attached to a wall, without being exposed to view above said picture frame;

C) a support portion which is bent, as a second bend, through more than 90° in relation to said groove portion and is disposed diagonally to said wall portion; and D) a terminal portion, comprising said second end of said metal strip, which is bent, as a third bend, through less than 90° in relation to said support portion and is disposed substantially in parallel to said wall portion.

8. The metal hanger of claim 7 which further comprises a first nail hole which is near said groove portion and is in the form of two holes through said support portion and through said wall portion, said holes being substantially within a plane that passes through said longitudinal axis and is perpendicular to a plane disposed in parallel to said straight wall portion, said holes being additionally disposed diagonally to said straight wall portion.

9. The metal hanger of claim 8 which further comprises a second nail hole which is near said first and second ends of said metal strip and is in the form of two holes through said terminal portion and through said wall portion, said holes being perpendicularly aligned to said terminal portion and said wall portion.

* * * * *